US006644991B2

(12) United States Patent
Martin

(10) Patent No.: US 6,644,991 B2
(45) Date of Patent: Nov. 11, 2003

(54) MATE ASSIST ASSEMBLY FOR JOINING ELECTRICAL CONTACTS

(75) Inventor: Galen Monroe Martin, Camp Hill, PA (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 10/056,612

(22) Filed: Jan. 23, 2002

(65) Prior Publication Data

US 2003/0139076 A1 Jul. 24, 2003

(51) Int. Cl.[7] ..... H01R 13/62
(52) U.S. Cl. ..... 439/157; 439/372
(58) Field of Search ..... 439/157, 152, 439/372, 159, 160, 153, 155, 156

(56) References Cited

U.S. PATENT DOCUMENTS 5,110,301 A * 5/1992 Inoue et al. ..... 439/310
5,593,309 A 1/1997 Post et al.
5,785,558 A 7/1998 Post et al.
5,833,484 A 11/1998 Post et al.
6,099,330 A 8/2000 Gundermann et al.
2001/0046797 A1 * 11/2001 Sasaki et al. ..... 439/157

* cited by examiner

*Primary Examiner*—Ross Gushi

(57) ABSTRACT

An electrical connector is provided including first and second housings having rear ends configured to receive first and second sets of electrical contacts. The first and second housings have front ends that are matable with one another to join corresponding contacts from the first and second sets. The first and second housings are movable between initial and final positions. The electrical connector includes a lever member engaging the first and second housings and moving the first and second housings between the initial and final positions as the lever member is rotated through a range of motion. The lever member includes a cam arm having a first retention element and a second retention element. The electrical connector includes a lever retention block within an interior region of the first housing that has a pivot chamber that retains, and permits the rotation of, the first retention element within the pivot chamber.

26 Claims, 6 Drawing Sheets

MATE ASSIST ASSEMBLY FOR JOINING ELECTRICAL CONTACTS

BACKGROUND OF THE INVENTION

Certain embodiments of the present invention generally relate to a lever-based connection assembly for engaging resisting components. More particularly, certain embodiments of the present invention relate to a mate assist assembly for connecting electrical contacts contained in separate housings.

In certain applications, electronic components require the mating of several electrical contacts, such as in automotive electrical components. The electronic component includes a connector housing that holds several electrical contacts, while a mating connector housing holds an equal number of electrical contacts. One connector housing includes male electrical contacts, while the other connector housing includes female electrical contacts. As the number of electrical contacts to be mated increases, it becomes difficult to fully join the mating connector housings because of friction between the mating electrical contacts. The connector housings are formed with a mate assist assembly that includes a lever-and-gear system to pull together the connector housings in order to overcome the frictional resistance created by the mating electrical contacts.

A mate assist assembly is described in U.S. Pat. No. 6,099,330 issued to Gundermann that includes a lever, and first and second connector housings. Each connector housing includes electrical contacts, and the first connector housing is configured to be positioned inside the second connector housing. The lever has a handle and two arms. The arms extend from, and may be rotated alongside, end walls of the second connector housing. The arms include lever surfaces that are positioned on the end walls. The second connector housing, with the handle positioned proximate a top end, may be slid over the first connector housing to a point where the electrical contacts resist further insertion. The lever then is rotated downward along a back wall of the second connector housing which causes the lever surfaces to engage cam surfaces located on end walls of the first connector housing. As the lever surfaces engage, and are resisted by, the cam surfaces, the second connector housing is pulled further downward over the first connector housing until the electrical contacts are fully mated.

Another mate assist assembly is described in U.S. Pat. No. 5,833,484 issued to Post that is similar to the '330 patent, except that the second connector housing and arms of the lever are positioned on the first connector housing. Each arm includes a pinion with gears. The first connector housing includes racks situated on the first connector housing with each rack corresponding to the gear teeth of one of the pinions. As the handle is rotated upward, the racks and pinions engage and pull the second connector housing downward into the first connector housing.

However, conventional mate assist assemblies suffer from a number of drawbacks. First, the arms of the lever extend out from the end walls of the connector housings and the handle extends across the top of the connector housings to the arms. The levers are therefore wide and bulky and may be difficult to rotate. Also, the levers interfere with electrical wire extending from the connector housings, and may prevent the mate assist assemblies from being used with certain space-confined electronic components. Secondly, the mate assist assemblies are time-consuming to assemble and install. The arms are pulled apart and slid along the end walls of the second connector housing. Then each arm is individually positioned into a retention cavity or aperture.

Thus a need remains for a mate assist assembly that overcomes the above mated problems and addresses other concerns experienced in the prior art.

BRIEF SUMMARY OF THE INVENTION

Certain embodiments provide an electrical connector that includes a first housing and a second housing having rear ends configured to receive first and second sets of electrical contacts. The first and second housings also include front ends that are matable with one another to join corresponding contacts from the first and second sets of electrical contacts. The first and second housings are movable between initial and final positions, at which the first and second sets of contacts partially and fully mate, respectively. The electrical connector includes a lever member that engages the first and second housings and moves the first and second housings between the initial and final positions as the lever member is rotated through a range of motion. The lever member includes a cam arm that has a first retention element provided on at least one side of the cam arm to engage the first housing and a second retention element provided on a peripheral surface of the cam arm to engage the second housing. The electrical connector includes a lever retention block provided within an interior region of the first housing. The lever retention block has a pivot chamber that retains the first retention element while permitting rotation of the first retention element within the pivot chamber as the lever member rotates through the range of motion.

DETAILED DESCRIPTION OF THE INVENTION

Figure 1:
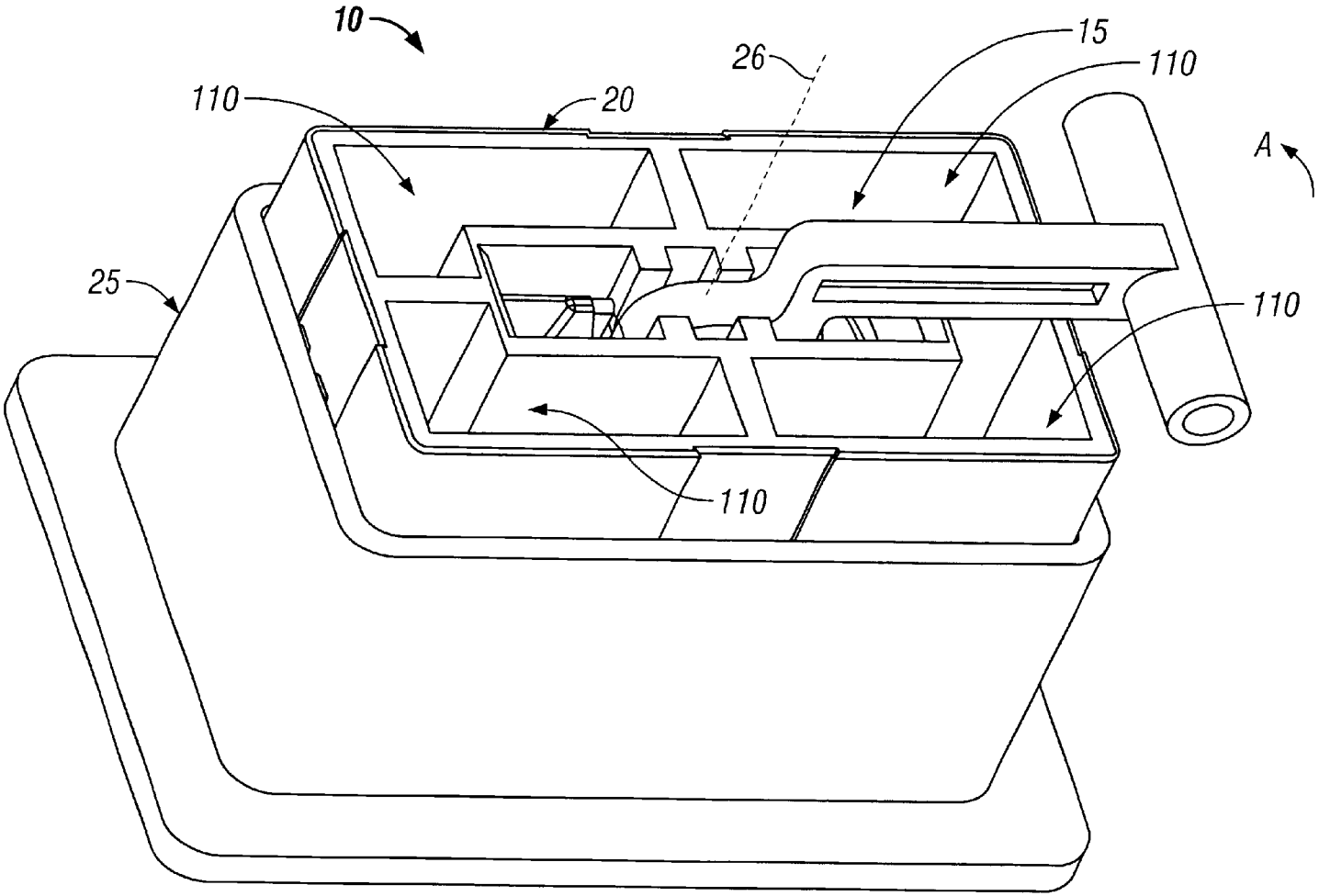
FIG. 1 illustrates an isometric view of a mating assist assembly according to an embodiment of the present invention.
Figure 9:
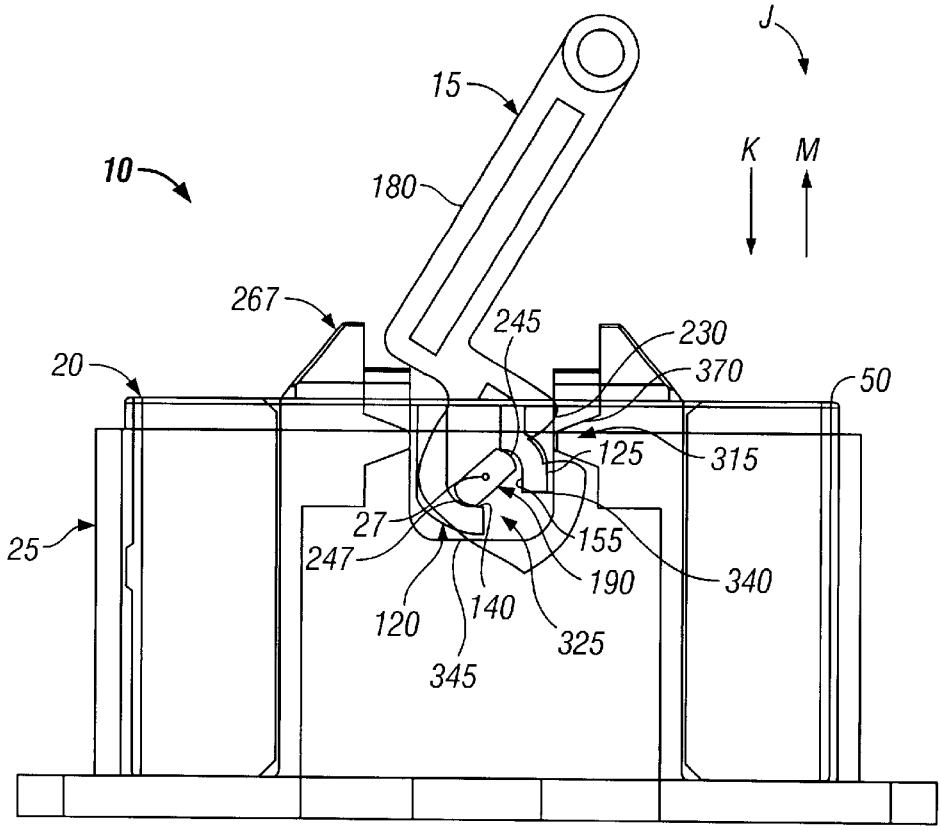
FIG. 9 illustrates a side cutaway view of the mating assist assembly of FIG. 1 in the final mated position.

FIG. 1 illustrates an isometric view of a mating assist assembly 10 according to an embodiment of the present invention. The mating assist assembly 10 includes a lever member 15, a harness connector 20, and a module connector 25 aligned along a vertical axis 26. The harness connector 20 contains contact pockets 110 configured to receive packets that hold groups of electrical contacts. The module connector 25 holds electrical contacts configured to mate with electrical contacts in the harness connector 20. FIG. 1 illustrates the harness connector 20 partially inserted within the module connector 25 to an initial staging position. The lever member 15 is held within, and engages, the harness connector 20 and the module connector 25. The lever member 15 is rotatable in the direction of arrow A from the initial staging position to a final mating position (FIG. 9). As the level member 15 is rotated, it presses the harness connector 20 downward into the module connector 25 and fully mates the electrical contacts of the harness connector 20 and the module connector 25 with each other.

Figure 2:
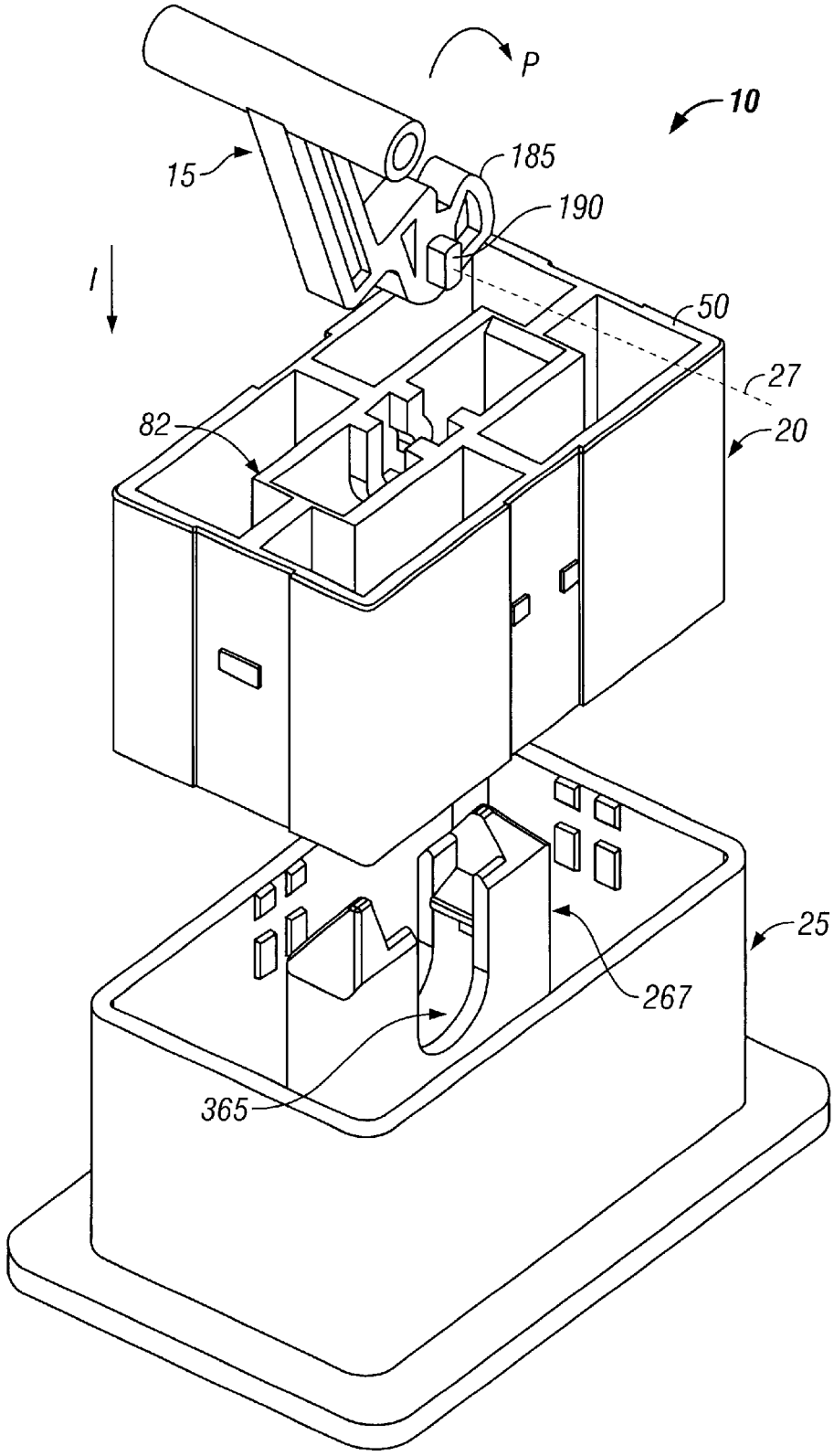
FIG. 2 illustrates an exploded isometric view of the mating assist assembly of FIG. 1.

FIG. 2 illustrates an exploded isometric view of the mating assist assembly 10 of FIG. 1. The lever member 15 includes a cam arm 185 and pivot posts 190 on opposite sides of the cam arm 185. The harness connector 20 includes a lever retention block 82 formed in the center thereof. The module connector 25 includes a mating post 267 formed in the center thereof. The mating post 267 includes catch notches 325. The lever member 15 is removably inserted downward in the direction of arrow I into the harness connector 20 with the cam arm 185 and the pivot posts 190 positioned within the lever retention block 82. The lever member 15 is then rotated in the direction of arrow P about a rotational axis 27 to a top surface 50. The harness connector 20 is then removably inserted in the direction of arrow I into the module connector 25 to the initial staging position shown in FIG. 1, at which the mating post 267 projects up into the lever retention block 82 and the cam arm 185 situated within the catch notches 325.

Figure 3:
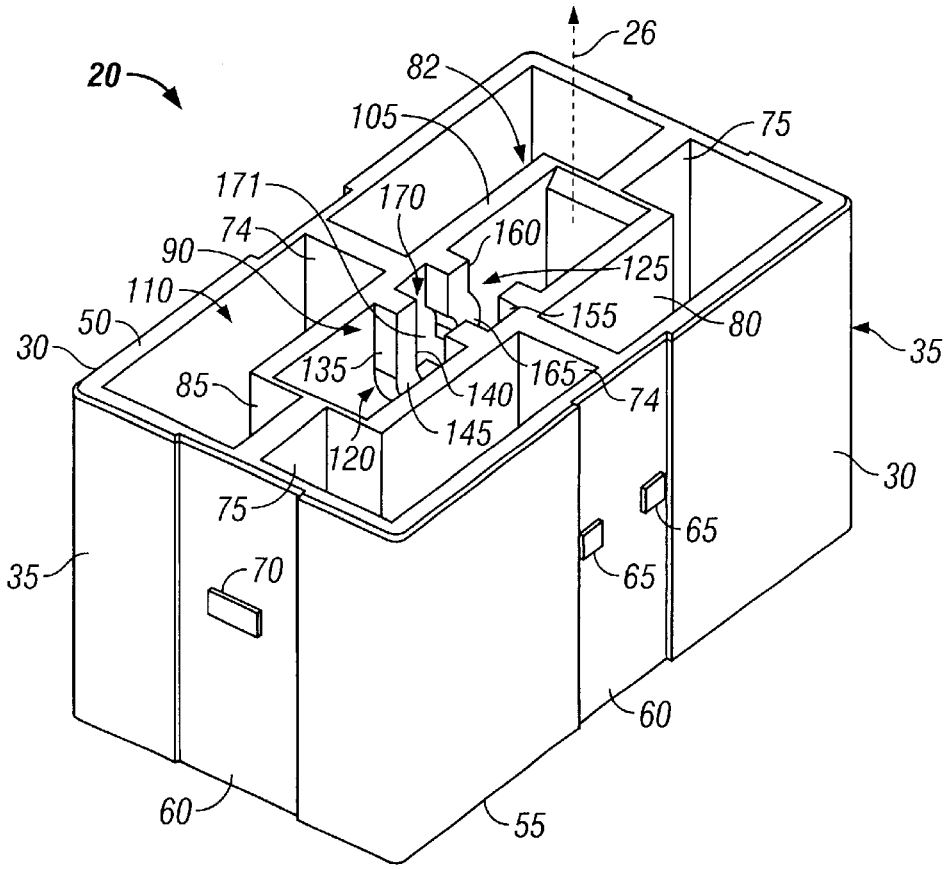
FIG. 3 illustrates an isometric view of the harness connector of FIG. 1.

FIG. 3 illustrates an isometric view of the harness connector 20 of FIG. 1. The harness connector 20 is box shaped and includes opposing side walls 30 and opposing end walls 35. By way of example only, the side walls 30 are formed integral with, and are perpendicular to, the end walls 35. A perimeter around the exterior of the harness connector 20 is smaller than an interior perimeter of the module connector 25 of FIG. 1, in order that the harness connector 20 may be positioned within the module connector 25. The harness connector 20 is symmetrical, so that the harness connector 20 may be positioned inside the module connector 25 of FIG. 1 in one of two different alignments turned 180 degrees.

The side and end walls 30 and 35 each include a rectangular recessed portion 60 that is centered in the corresponding side and end walls 30 and 35, and that extends from a bottom surface 55 to the top surface 50. The recessed portions 60 of the side walls 30 each include two square shaped retention protrusions 65 that extend outward. The recessed portions 60 of the end walls 35 each include a rectangular shaped retention protrusion 70 that extends outward. The retention protrusions 65 and 70 engage interior surfaces 275 (FIG. 7) of the module connector 25 as the harness connector 20 is slidably inserted into the module connector 25 and retain the harness connector 20 in the initial staging position within the module connector 25 (as explained below in more detail in connection with FIG. 7).

The side and end walls 30 and 35 are formed integral with thin rectangular support walls 74 and 75, respectively, that are centered along interior surfaces of the side walls 30 and 35. The support walls 74 and 75 extend perpendicularly inward from the side and end walls 30 and 35, respectively. The support walls 74 and 75 are formed integral with the lever retention block 82 to hold the lever retention block 82 in a desired position. The lever retention block 82 is formed with interior side walls 80 and interior end walls 85 that define and enclose a rectangular cavity 90. The interior side and end walls 80 and 85 include top surfaces 105. The lever retention block 82 receives, within the cavity 90, the mating post 267 on the module connector 25 of FIG. 2. The side and end walls 30 and 35, the support walls 75, and the interior side and end walls 80 and 85 form the contact pockets 110 that extend through the harness connector 20 between the top and bottom surfaces 50 and 55. By way of example, only the contact pockets 110 are L-shaped. The contact pockets 110 are configured to receive one or more contacts that mate with corresponding contacts in the module connector 25. Electrical contacts (not shown) are loaded through each of the four contact pockets 110 from one end of the harness connector 20 toward a second end of the harness connector 20. When the bottom surface 55 of the harness connector 20 is slidably inserted into the module connector 25, the electrical contacts engage electrical contacts (not shown) situated in the module connector 25.

The interior side walls 80 include J-shaped ribs 120 and gearing ribs 125 formed thereon. The J-shaped ribs 120 extend inward from the interior side walls 80 and are aligned opposite each other across the cavity 90. Likewise, the gearing ribs 125 extend inward from the interior side walls 80 and are aligned opposite each other across the cavity 90. The J-shaped ribs 120 and gearing ribs 125 that are provided on the same interior side wall 80 include lead ends that are separated by an insertion gap 170 and body sections that define a pivot chamber 171.

The J-shaped ribs 120 include rear and front surfaces 135 and 140 that extend downward parallel to each other from the top surface 105 and curve inward toward the gearing ribs 125 to form the J shape. Side surfaces 145 of the J-shaped ribs 120 are perpendicular to the rear and front surfaces 135 and 140 and face inward toward each other across the cavity 90.

The gearing ribs 125 include rear and front surfaces 155 and 160 that extend downward parallel to each other from the top surface 105 and curve semi-circularly and concentrically away from the front surfaces 140 of the J-shaped ribs 120. Side surfaces 165 of the gearing ribs 125 are perpendicular to the rear and front surfaces 155 and 160 and face inward toward each other across the cavity 90.

In operation, the lever member 15 is inserted into the cavity 90 with the pivot posts 190 of the lever member 15 (FIG. 4) sliding into the insertion gaps 170 until the pivot posts 190 are positioned in the pivot chambers 171 on top of the front surfaces 140 of the J-shaped ribs 120 and underneath and behind the rear surfaces 155 of the gearing ribs 125. The pivot posts 190 are rectangular and thus are only insertable into the insertion gaps 170 when aligned along the vertical axis 26. The pivot posts 190 are rotatable within the pivot chambers 171.

The harness connector 20 is then slidably inserted into the module connector 25. When the harness connector 20 is fully inserted into the module connector 25, the mating post 267 (FIG. 2) of the module connector 25 extends upward through the cavity 90 between the J-shaped ribs 120 and the interior end walls 85 and between the gearing ribs 125 and the interior end walls 85. The mating post 267 of the module connector 25 positioned within the cavity 90 of the lever retention block 82 catches the lever member 15 as the lever member 15 is rotated in the pivot chambers 171, causing the harness connector 20 to be pulled into the module connector 25.

Figure 4:
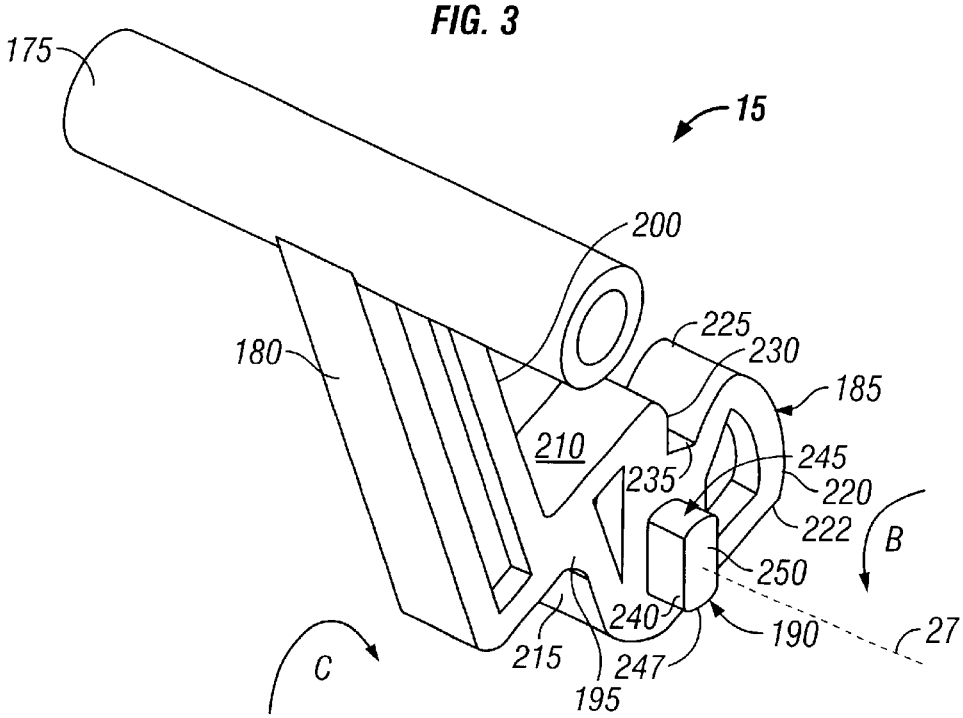
FIG. 4 illustrates an isometric view of a lever member for the mating assist assembly according to an embodiment of the present invention.

FIG. 4 illustrates an isometric view of the lever member 15 for the mating assist assembly 10 according to an embodiment of the present invention. The lever member 15 includes a cylindrical handle 175, a rectangular shaft 180, the elbow shaped cam arm 185, and the two rectangular pivot posts 190. The handle 175 is formed integral with, and extends perpendicularly from, a first end of the shaft 180 to form a T-shape. The cam arm 185 is formed integral with, and extends outward from a second end of the shaft 180. The shaft 180 includes a back surface 200. The shaft 180 and the cam arm 185 share exterior side surfaces 195. The shaft 180 and the handle 175 may be used to position the lever member 15 So that the pivot posts 190 rotate within the pivot chambers 171 of FIG. 2 and cause the cam arm 185 to catch or release the module connector 25 of FIG. 1.

The cam arm 185 also includes a curved first contact wall 225, a curved second contact wall 230, and a curved retention wall 235. The first contact wall 225 curves out from a back surface 220 of the cam arm 185 toward the back surface 200 of the shaft 180 to join the retention wall 235. The retention wall 235 extends upward at an acute angle to a bottom surface 222 of the cam arm 185 to join the second contact wall 230. The second contact wall 230 curves upward and out from the retention wall 235 to a top surface 210 of the cam arm 185. The first contact wall 225 catches the mating post 267 of FIG. 2 and pulls the harness connector 20 of FIG. 2 down into the module connector 25 of FIG. 2 when the pivot posts 190 are rotated in the direction of arrow B about the rotational axis 27 within the pivot chambers 171 shown in FIG. 3. The second contact wall 230 catches the mating post 267 and pushes the harness connector 20 up and out of the module connector 25 when the pivot posts 190 are rotated in the direction of arrow C about the rotational axis 27 within the pivot chambers 171. The retention wall 235 holds and retains a front portion 380 (FIG. 7) of the mating post 267 that the first and second contact walls 225 and 230 catch.

The pivot posts 190 are aligned with each other on the opposite side surfaces 195 of the cam arm 185 and extend outward and perpendicularly away from the side surfaces 195. The pivot posts 190 include flat side walls 240, rounded top walls 245, rounded bottom walls 247, and flat exterior surfaces 250. The side walls 240 are situated at an acute angle to the bottom surface 222 of the cam arm 185. The side walls 240, top walls 245, and bottom walls 247 engage the J-shaped ribs 120 and the gearing ribs 125 when the pivot posts 190 are positioned in the pivot chambers 171.

Figure 5:
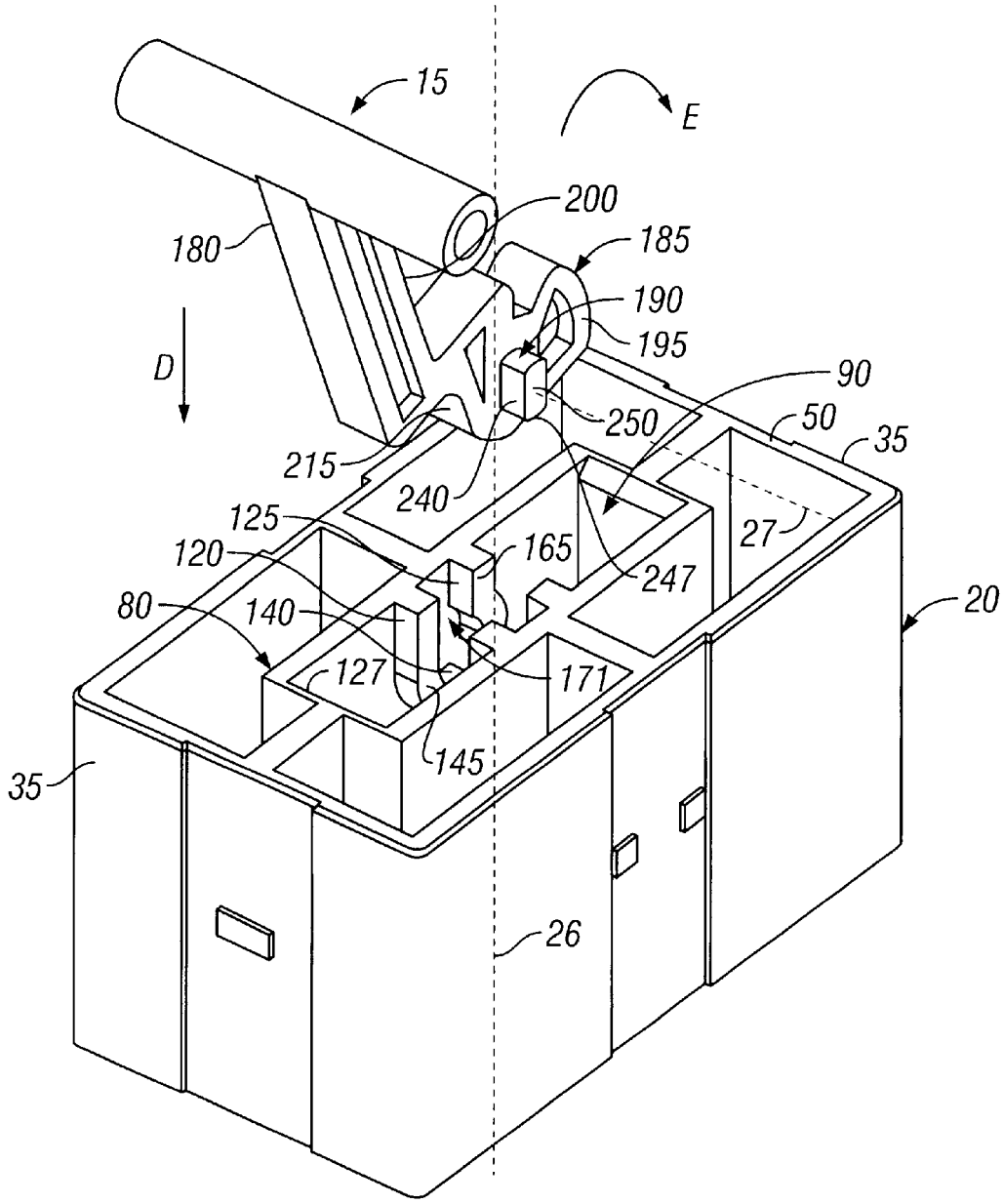
FIG. 5 illustrates an exploded isometric view of the lever member and the harness connector of FIG. 1.

FIG. 5 illustrates an exploded isometric view of the lever member 15 and the harness connector 20 of FIG. 1. In operation, the lever member 15 is oriented so that the side walls 240 of the pivot posts 190 are parallel to the vertical axis 26. The lever member 15 may then be inserted downward in the direction of arrow D into the cavity 90 with a front surface 215 of the cam arm 185 facing toward an inner surface 121. The lever member 15 is fully inserted in the cavity 90 with the exterior side surfaces 195 of the cam arm 185 positioned between and contacting the side surfaces 145 and 165 of the opposite J-shaped ribs 120 and the opposite gearing ribs 125, respectively, and with the pivot posts 190 positioned within the pivot chambers 171 and resting on the J-shaped ribs 120. When the side walls 240 of the pivot posts 190 are parallel to the vertical axis 26, the bottom walls 247 of the pivot posts 190 contact the front surfaces 140 of the J-shaped ribs 120 and the exterior surfaces 250 of the pivot posts 190 contact the interior side walls 80 of the harness connector 20. The lever member 15 is then rotated in the direction of arrow E about the rotational axis 27 until the back surface 200 of the shaft 180 rests on the top surface 50 of one of the end walls 35.

Figure 6:
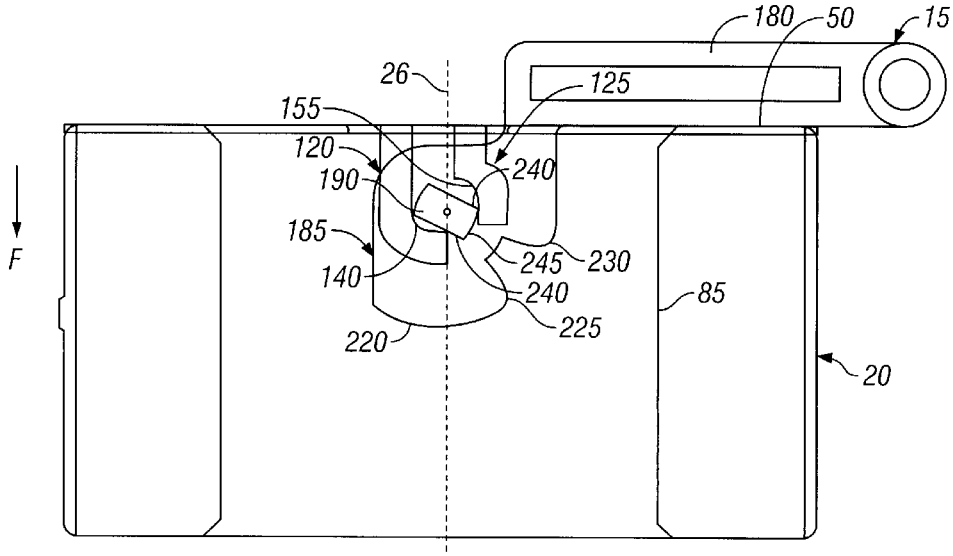
FIG. 6 illustrates a cutaway side view of the lever member of FIG. 1 positioned within the harness connector of FIG. 1.

FIG. 6 illustrates a cutaway side view of the lever member 15 of FIG. 1 positioned within the harness connector 20 of FIG. 1. One side wall 240 of the pivot post 190 rests upon the front surface 140 of the J-shaped rib 120 and the other side wall 240 and the top wall 245 engage the rear surface 155 of the gearing rib 125. The first contact wall 225 thus faces one of the interior end walls 85 and the second contact wall 230 faces downward in the direction of arrow F.

Figure 7:
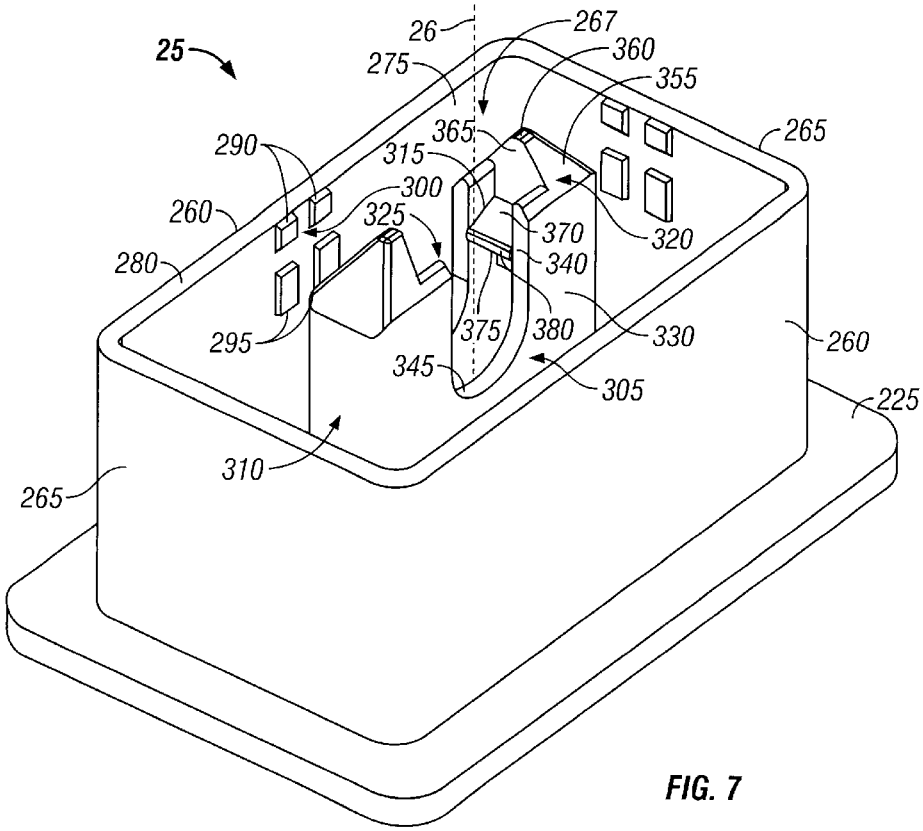
FIG. 7 illustrates an isometric view of the module connector of FIG. 1.

FIG. 7 illustrates an isometric view of the module connector 25. Two side walls 260 are formed integral with, and are aligned perpendicular to, end walls 265. A base 255 is formed integral with, and extends outward from, the side and end walls 260 and 265. The base 255 is mounted to an electronic component (not shown), such as a radio, with the side and end walls 260 and 265 extending outward from the electronic component. The mating post 267 is also mounted to the electronic component and centered between the side and end walls 260 and 265. Electrical contacts (not shown) extend from the electronic component through the module connector 25 around the mating post 267 and between the side and end walls 260 and 265. The module connector 25 is symmetrical throughout, so the module connector 25 may be mounted on the electronic component in one of two different alignments turned 180 degrees.

Each side and end wall 260 and 265 includes two upper protrusions 290 and two lower protrusions 295 that are generally centered on, and extend inward from, the interior surface 275. The upper protrusions 290 are aligned next to each other along a top surface 280, and the lower protrusions 295 are aligned next to each other and are below the upper protrusions 290 to form a retention gap 300 between the upper protrusions 290 and the lower protrusions 295. The retention gap 300 is generally similar in size to the retention protrusions 65 and 70 of the harness connector 20 of FIG. 3. Therefore, when the harness connector 20 is initially positioned into the initial staging position inside the module connector 25, the retention protrusions 65 and 70 engage and slide past the upper protrusions 290, and are retained in the retention gap 300. When the lever member 15 is rotated upward in the direction of arrow G (FIG. 8) about the rotational axis 27 and the harness connector 20 is pulled further downward in the direction of arrow L (FIG. 8) to connect the electrical contacts, the retention protrusions 65 and 70 of the harness connector 20 of FIG. 3 slide out of the retention gap 300 over the lower protrusions 295 to a resting position below the lower protrusions 295. The retention, lower, and upper protrusions 65, 70, 295, and 290 thus engage each other to retain the harness connector 20 in the staging position in the module connector 25.

The mating post 267 includes opposed parallel side walls 305, and opposed parallel end walls 310 extending upward through an interior region of the module connector 25. The side walls 305 include the opposed U-shaped catch notches 325, which are defined by flat inner walls 340 and a concave bottom wall 345. The side walls 305 may be formed integral with, and aligned perpendicular to, the end walls 310. The side and end walls 305 and 310 engage and slide along the interior side and end walls 80 and 85, respectively, when the harness connector 20 is inserted into the module connector 25.

The mating post 267 includes resistance portions 320 that each have three sloped walls 355 and a top surface 360. Two of the sloped walls 355 extend upward toward each other at an obtuse angle from exterior surfaces 330 of the side walls 305, and one of the sloped walls 355 extends upward at an obtuse angle from the exterior surface 330 of one of the end walls 310. All three sloped walls 355 are joined to the top surface 360 above the side and end walls 305 and 310. The shaft 180 of FIG. 4 is positioned horizontally on top of one of the top surfaces 360 perpendicular to the vertical axis 26 when the harness connector 20 is in the staging position within the module connector 25. Each resistance portion 320 also includes a resistance wall 365 that extends vertically downward from the top surface 360 between, and perpendicular to, the side walls 305 to a camming tooth 315. The resistance walls 365 are positioned to engage and resist the shaft 180 as the shaft 180 is moved from a horizontal position on top of one of the top surfaces 360 upward to a position at an acute angle to the vertical axis 26.

The camming teeth 315 are situated between the side walls 305 and include ridged top portions 370, ridged bottom portions 375, and the flat front portions 380. Each front portion 380 is perpendicular to, and aligned on a plane with, the inner walls 340 of one of the catch notches 325. Each top portion 370 extends upward toward one of the resistance walls 365 at an obtuse angle to the front portion 380 and each bottom portion 375 extends downward toward one of the resistance walls 365 at an obtuse angle to the front portion 380.

Figure 8:
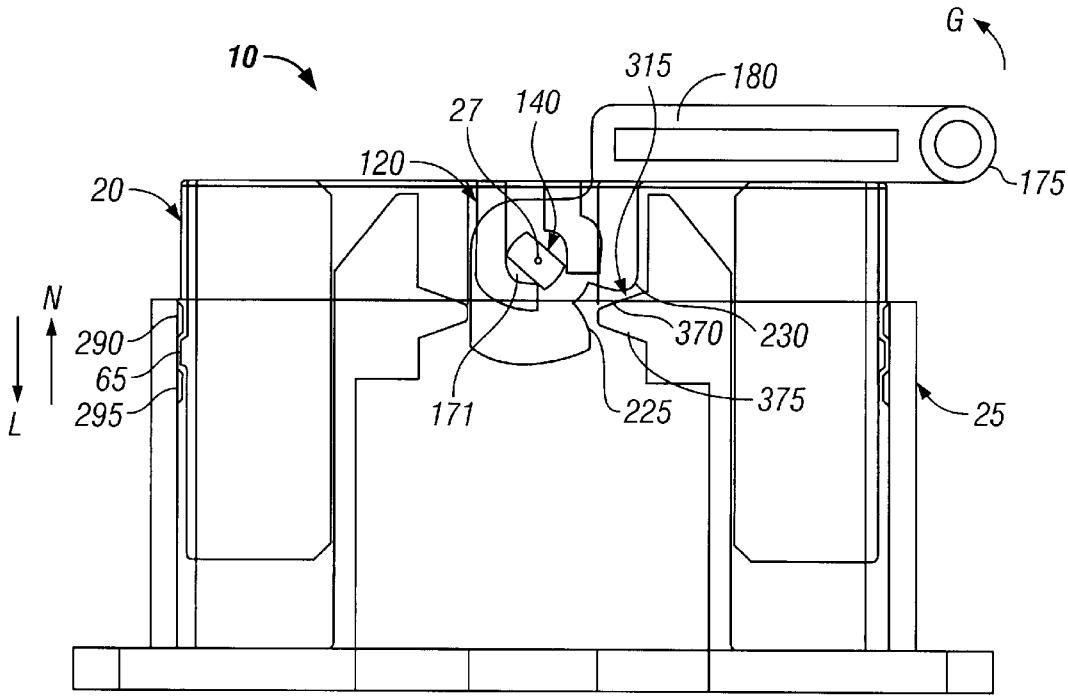
FIG. 8 illustrates a cutaway side view of the mating assist assembly of FIG. 1 in the initial staging position.

FIG. 8 illustrates a cutaway side view of the mating assist assembly 10 of FIG. 1 in the staging position. The upper and lower protrusions 290 and 295 of the module connector 25 engage the protrusions 65 of the harness connector 20. The first contact wall 225 is positioned proximate the bottom portion 375 of one of the camming teeth 315, and the second contact wall 230 is positioned above the top portion 370 of the camming tooth 315. The handle 175 is then used to rotate the shaft 180 upward in the direction of arrow G about the rotational axis 27. As the shaft 180 is rotated, the pivot posts 190 rotate in the direction of arrow G about the rotational axis 27 within the pivot chambers 171 causing the first contact wall 225 to move upward in the direction of arrow N and catch the bottom portion 375 of the camming tooth 315. As the first contact wall 225 pushes against, and is resisted by, the bottom portion 375, the pivot posts 190 are pushed downward in the direction of arrow L against the J-shaped ribs 120 and thus position the harness connector 20 further downward into the module connector 25.

FIG. 9 illustrates a side cutaway view of the mating assist assembly 10 of FIG. 1 in the final position. When the harness connector 20 has been fully inserted into the module connector 25, the shaft 180 is positioned at an angle, generally 60 degrees, to the top surface 50, and the top walls 245 of the pivot posts 190 engage the rear surfaces 155 of the gearing ribs 125 and the bottom walls 247 of the pivot posts 190 engage the front surfaces 140 of the J-shaped ribs 120. The mating post 267 extends through the cavity 90 of the lever retention block 82 of FIG. 2. The J-shaped ribs 120 and gearing ribs 125 are positioned in the catch notches 325 above the bottom walls 345 and between the inner walls 340 of the mating post 267. The harness connector 20 may be removed from the module connector 25 by rotating the lever member 15 back downward in the direction of arrow J about the rotational axis 27 until the shaft 180 is positioned on top of the top surface 50. As the lever member 15 is rotated in the direction of arrow J about the rotational axis 27, the second contact wall 230 engages the top portion 370 of the camming tooth 315 and pushes downward in the direction of arrow K against the top portion 370. The rear surfaces 155 of the gearing ribs 125 push downward in the direction of arrow K against the pivot posts 190 and retain the pivot posts within the pivot chambers 171. Therefore, as the second contact wall 230 pushes downward in the direction of arrow K against the top portion 370 of the camming tooth 315, the pivot posts 190 are pulled upward in the direction of arrow M and likewise pull upward in the direction of arrow M the J-shaped ribs 120 and gearing ribs 125, and thus lift the harness connector 20 partially out of the module connector 25. The harness connector 20 may then be fully removed from the module connector 25 by hand or a tool.

In an alternative embodiment, the cam arm 185, pivot posts 190, and mating post 267 may be oriented so that the shaft 180 of the lever member 15 may be positioned upright at a 90 degree angle to the top surfaces 50 when the harness connector 20 is fully inserted into the module conductor 25. Similarly, the cam arm 185, pivot posts 190, and the mating post 267 may be oriented so that the shaft 180 of the lever member 15 is vertically upright and parallel with the vertical axis 26 when the harness connector 20 is initially inserted into the module connector 25 to the staging position. The lever member 15 may then be rotated downward in the direction of arrow J (FIG. 9) about the rotational axis 27 (FIG. 9) until the shaft 180 is horizontal and resting upon the top surface 50 of an end wall 35 to fully insert the harness connector 20 into the module connector 25.

The mating assist assembly 10 takes up less space and thus may be used with a greater variety of electronic components. Also, the mating assist assembly 10 is easily assembled by lowering the lever member 15 within the pivot chambers 171 of the harness connector 20 and then positioning the harness connector 20 within the module connector 25. Thus, assembling and implementing the mating assist assembly 10 may require limited time and effort.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector, comprising:

first and second housings having rear ends configured to receive electrical contacts, said first and second housings having front ends configured to be matable with one another to join corresponding contacts, said first and second housings being movable between initial and final positions, at which corresponding electrical contacts partially and fully mate, respectively;

a lever member engaging said first and second housings and moving said first and second housings between said initial and final positions as said lever member is rotated through a range of motion, said lever member including a cam arm having a first retention element provided on at least one side of said cam arm to engage said first housing and a second retention element provided on a peripheral surface of said cam arm to engage said second housing; and a lever retention block provided within an interior region of said first housing and having a pivot chamber that retains said first retention element while permitting rotation of said first retention element within said pivot chamber as said lever member rotates through said range of motion.

2. The electrical connector of claim 1, wherein said lever retention block is centered within said first housing and is surrounded by contact receiving pockets configured to receive electrical contacts.

3. The electrical connector of claim 1, wherein said lever retention block is located between at least two contact receiving pockets configured to receive electrical contacts.

4. The electrical connector of claim 1, wherein said lever retention block includes opposed side walls that receive said lever member therebetween, said side walls including pivot chambers formed therein to pivotally retain said first retention element on said cam arm.

5. The electrical connector of claim 1, wherein said lever retention block includes a chamber formed therein to pivotally receive said lever member.

6. The electrical connector of claim 1, wherein said lever retention block includes side walls having insertion gaps formed in facing surfaces of said side walls, said insertion gaps receiving said first retention element on said cam arm.

7. The electrical connector of claim 1, wherein said lever retention block includes a side wall having ribs formed thereon to define an insertion gap and to define a pivot chamber between said ribs, said first retention element being loaded through said insertion gap into said pivot chamber.

8. The electrical connector of claim 1, wherein said first retention element including at least one rectangular pivot post formed on, and extending outward from, at least one side of said cam arm.

9. The electrical connector of claim 1, wherein said lever retention block including a pivot chamber that receives and permits rotation of said first retention element as said lever member rotates through said range of motion, said lever retention block, including an insertion gap communicating with said pivot chamber and cam figured to accept said first retention element when said lever arm is oriented at a first end of said range of motion.

10. An electrical connector, comprising:

first and second housings having rear ends configured to receive first and second sets of electrical contacts, said first and second housings having front ends that are matable with one another to join corresponding electrical contacts, said first and second housings being movable between initial and final positions, at which said first and second housings partially and fully mate, respectively;

a lever member engaging said first and second housings and moving said first and second housings between said initial and final positions as said lever member is rotated through a range of motion, said lever member including a cam arm having a first retention element provided on at least one side of said cam arm to engage said first housing and a second retention element provided on a peripheral surface of said cam arm to engage said second housing; and a mating post mounted within an interior region of said second housing, said mating post being slidably received within a chamber provided in an interior region of said first housing, said mating post having a notched-out portion configured to receive said cam arm, said notched-out portion including a cam retention element configured to engage and hold said second retention element on said lever member as said lever member is rotating through said range of motion.

11. The electrical connector of claim 10, wherein said second retention element constitutes a notch formed in a peripheral surface of said cam arm and said cam retention element constitutes a cam tooth facing said notched-out portion of said mating post.

12. The electrical connector of claim 10, wherein said mating post includes opposed side walls separated by a cavity that receives a portion of said cam arm.

13. The electrical connector of claim 10, wherein said mating post includes opposed side walls and a cam tooth extending between said side walls, said cam tooth forming said cam retention element.

14. The electrical connector of claim 10 further comprising:

a lever retention block provided within an interior region of said first housing and having a pivot chamber that retains said first retention element while permitting rotation of said first retention element within said pivot chamber as said lever member rotates through said range of motion.

15. An electrical connector comprising:

first and second housings having rear ends configured to receive first and second sets of electrical contacts, said first and second housings having front ends that are matable with one another, said first and second housings being movable between initial and final positions, at which said first and second housings partially and fully mate, respectively;

a first interior wall provided within an interior of said first housing;

a second interior wall provided within an interior of said second housing, said first and second interior walls being aligned adjacent to one another and sliding relative to one another when said first and second housings are moved from said initial position to said final position; and a lever arm having first means for pivotally engaging said first interior wall and second means for securely engaging said second interior wall, said first and second means cooperating to slide said first and second interior walls relative to one another as said lever arm is rotated through a range of motion.

16. The electrical connector of claim 15, wherein said first interior wall includes a pair of interior walls spaced apart by a distance sufficient to receive said lever arm therebetween.

17. The electrical connector of claim 15, wherein said first interior wall includes a pivot chamber formed therein to pivotally retain said first means.

18. The electrical connector of claim 15, wherein said first interior wall includes an insertion gap that permits passage of said first means when said lever arm is rotated to a loading position at one end of said range of motion.

19. The electrical connector of claim 15, wherein said first interior wall includes ribs formed thereon to define an insertion gap and to define a pivot chamber between said ribs, said first means being loaded through said insertion gap into said pivot chamber.

20. The electrical connector of claim 15, wherein said first means includes at least one pivot post formed on, and extending outward from, at least one side of said lever arm.

21. The electrical connector of claim 15, wherein said first means is loadable with said first interior wall only when said lever arm is rotated to a first end of said range of motion and said second means is securable to said second interior wall only when said lever arm is rotated to a second end of said range of motion.

22. An electrical connector, comprising:

a lever arm having a cam arm on one end of said lever arm, said cam arm including a post on one side and a contact wall on one end of said cam arm;

a first housing having an interior chamber receiving said lever arm, said chamber having ribs that rotatably retain said post;

a second housing configured to receive said first housing, said second housing having an interior mating post with at least one camming segment, said mating post being removably positioned within said chamber, said at least one camming segment being configured to securely engage said contact wall.

23. The electrical connector of claim 22, wherein said chamber includes two parallel side walls joined to the first housing through laterally extending support walls.

24. The electrical connector of claim 22, wherein said chamber includes interior side surfaces with curved ribs extending inward therefrom, said ribs defining a pivot chamber receiving said post.

25. The electrical connector of claim 22, wherein said second housing and said mating post extend outward from an electronic component.

26. The electrical connector of claim 22, wherein said mating post includes two upright segments defining a gap therebetween, said gap receiving said post, said segments extending through said chamber.

* * * * *